US008295725B2

(12) United States Patent
Takahashi

(10) Patent No.: US 8,295,725 B2
(45) Date of Patent: Oct. 23, 2012

(54) FIXING DEVICE AND IMAGE FORMING APPARATUS

(75) Inventor: Hironori Takahashi, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 437 days.

(21) Appl. No.: 12/615,422

(22) Filed: Nov. 10, 2009

(65) Prior Publication Data

US 2010/0189478 A1 Jul. 29, 2010

(30) Foreign Application Priority Data

Jan. 23, 2009 (JP) ..... 2009-012532

(51) Int. Cl.
*G03G 15/20* (2006.01)

(52) U.S. Cl. ..... 399/67; 399/122; 399/320

(58) Field of Classification Search ..... 399/67, 399/122, 320
See application file for complete search history.

(56) References Cited

U.S. PATENT DOCUMENTS 6,628,916 B2 * 9/2003 Yasui et al. ..... 399/329
2004/0151515 A1 * 8/2004 Nakayama ..... 399/67
2005/0260015 A1 11/2005 Ito
2008/0031659 A1 2/2008 Ito
2008/0107436 A1 5/2008 Mikutsu

FOREIGN PATENT DOCUMENTS

| | | |
|---|---|---|
| CN | 1700119 | 5/2005 |
| CN | 101178567 | 11/2007 |
| JP | 06-337612 | 12/1994 |
| JP | 2004-279702 | 10/2004 |

* cited by examiner

*Primary Examiner* — Walter L Lindsay, Jr.
*Assistant Examiner* — Roy Y Yi
(74) *Attorney, Agent, or Firm* — K&L Gates LLP

(57) ABSTRACT

An image forming apparatus includes a fixing device. The fixing device includes a heating member and a pressing member that form a fixing nip, an approach guide positioned an upstream in a recording-medium conveyance direction of a fixing nip, a fixing-pressure-changing mechanism designed to change the fixing device between a high-pressure mode and a low-pressure mode, and an approach-guide-changing mechanism designed to change an angle of the approach guide in conjunction with the changing by the fixing-pressure-changing mechanism.

11 Claims, 7 Drawing Sheets

FIXING DEVICE AND IMAGE FORMING APPARATUS

INCORPORATION BY REFERENCE

This application is based upon and claims the benefit of priority from the corresponding Japanese Patent application No. 2009-012532, filed Jan. 23, 2009, the entire contents of which are incorporated herein by reference.

BACKGROUND

1. Field of the Invention

The present invention relates to fixing devices that are designed to change an approach guide, that guides a recording medium to a fixing nip, between different angles in conjunction with another operation such as changing between different fixing pressures, and to image forming apparatuses.

2. Description of the Related Art

A series of image forming operations performed in a typical image forming apparatus is as follows: an electrostatic latent image that is formed on an image carrier is developed and visualized as a toner image by a developer, the toner image is transferred onto a recording medium (e.g. a sheet of paper), the recording medium is conveyed to a fixing device, the toner image is fixed using heat and pressure that is applied by the fixing device, and the recording medium is discharged outside of the apparatus.

The fixing device includes a heating member and a pressing member that are rotatable and adjacent to each other. The pressing member is pressed against the heating member, producing a specific fixing pressure (nipping pressure) therebetween.

An exemplary situation will now be considered where an envelope, as a recording medium, is conveyed into such a fixing device. Envelopes are sheets of paper folded and pasted together at some portions thereof. When an envelope is conveyed into the fixing nip produced between the heating member and the pressing member, the envelope often becomes warped and wrinkled. To avoid this, when an envelope is conveyed into a fixing device, the fixing pressure is generally set to be as low as possible. Some known fixing devices include fixing-pressure-changing mechanisms designed to manually, or automatically, change the fixing pressure between different values that are provided for different types of recording media.

Such a fixing device includes an approach guide that guides the recording medium to the fixing nip. The approach guide is positioned the upstream in the recording medium conveyance direction of the fixing nip.

In a situation where a sheet of plain paper having a relatively small thickness is conveyed into the fixing device, the angle of the approach guide is preferably set so that a conveyance line formed at the fixing nip has a large curvature. This is because an increased area of the sheet of plain paper winds around the heating member, advantageously increasing fixability.

As mentioned above, envelopes are sheets of paper folded and pasted together at portions thereof. If the angle of the approach guide is set to a value that is intended for a sheet of plain paper and provides high fixability, the envelope curves due to the increased curvature. Consequently, even if the fixing pressure is reduced, the large difference in curvature produced between the front and back sides of the envelope, causes the envelope to easily wrinkle.

SUMMARY

It is an advantage of the present invention to provide a fixing device and an image forming apparatus capable of stably fixing an image on an envelope, without wrinkling the envelope. This is achieved by changing the approach guide that guides a recording medium to the fixing nip between different angles in conjunction with another operation such as changing the fixing pressures.

According to an embodiment of the present invention, an image forming apparatus includes a fixing device. The fixing device includes a heating member and a pressing member that are rotatable and are adjacent to each other, an approach guide is positioned an upstream in a recording-medium conveyance direction of a fixing nip formed between the heating member and the pressing member, a fixing-pressure-changing mechanism designed to change the fixing device between a high-pressure mode and a low-pressure mode, thereby modifying the fixing pressure from high to low, respectively, and an approach-guide-changing mechanism designed to change the approach guide between different angles in conjunction with the changes by the fixing-pressure-changing mechanism.

Additional features and advantages are described herein, and will be apparent from the following Detailed Description and the figures.

DETAILED DESCRIPTION

Embodiments of the present invention will now be described with reference to the accompanying drawings.

Image Forming Apparatus

Figure 1:
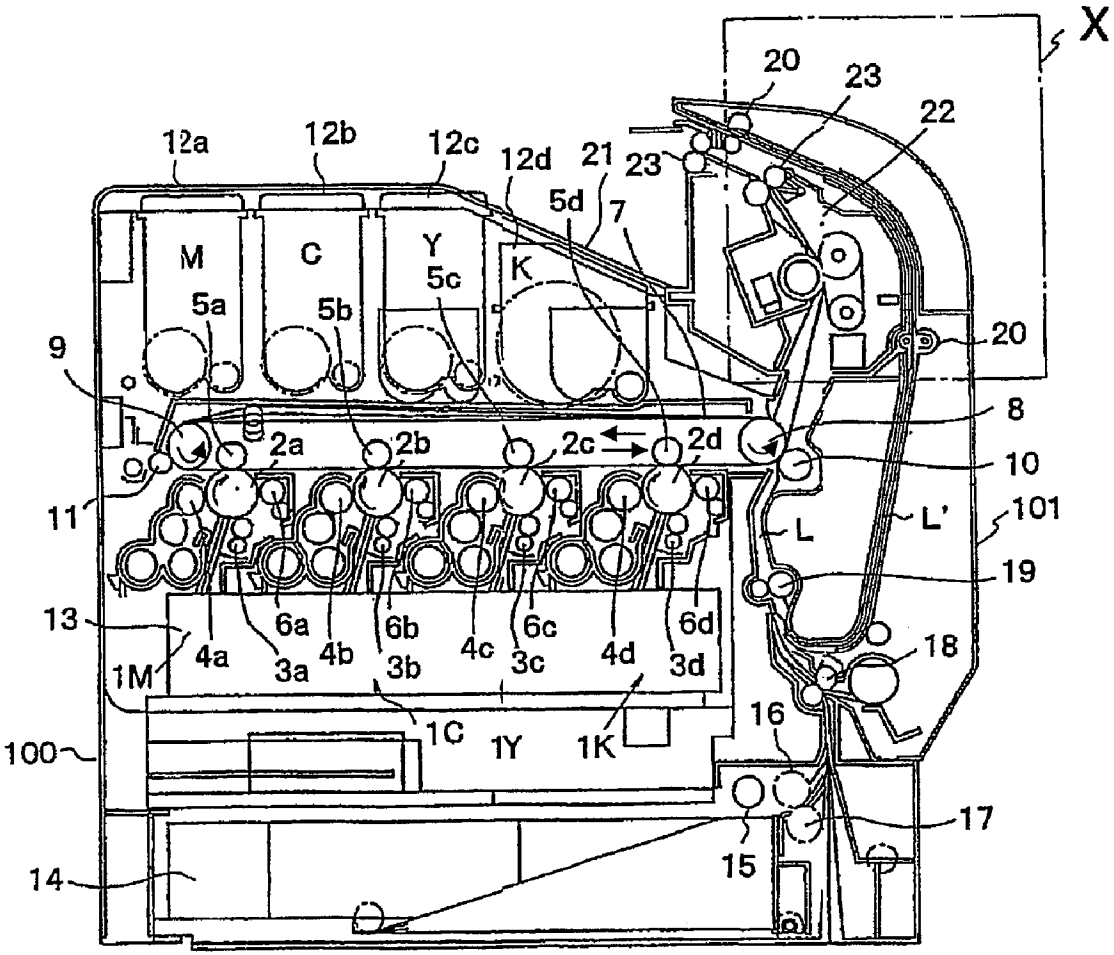
FIG. 1 is a cross-sectional view of a color laser printer according to an embodiment of the present invention.

FIG. 1 is a cross-sectional view of a color laser printer, the image forming apparatus according to an embodiment of the present invention. The color laser printer shown in FIG. 1 is a tandem type and includes, in a central region of a body 100 thereof, a magenta image forming unit 1M, a cyan image forming unit 1C, a yellow image forming unit 1Y, and a black image forming unit 1K that are arranged in tandem at specific intervals.

The image forming units 1M, 1C, 1Y, and 1K include photoconductive drums 2*a*, 2*b*, 2*c*, and 2*d*, respectively, with charging rollers 3*a*, 3*b*, 3*c*, and 3*d*; developers 4*a*, 4*b*, 4*c*, and 4*d*; transfer rollers 5*a*, 5*b*, 5*c*, and 5*d*; and drum cleaners 6*a*, 6*b*, 6*c*, and 6*d* are located around the photoconductive drums 2*a* to 2*d*, respectively.

The photoconductive drums 2*a* to 2*d* are image carriers having a drum-like shape and are driven by a motor (not shown) so as to rotate at a specific processing speed in the direction (clockwise) represented by arrows shown in FIG. 1.

The charging rollers 3*a* to 3*d* uniformly charge the surfaces of the respective photoconductive drums 2*a* to 2*d* with a charging bias applied from a charging-bias supply (not shown) so that the photoconductive drums 2*a* to 2*d* have a specific potential.

The developers 4*a* to 4*d* contain magenta (M) toner, cyan (C) toner, yellow (Y) toner, and black (K) toner, respectively. The developers 4*a* to 4*d* cause the toner to adhere to electrostatic latent images formed on the photoconductive drums 2*a* to 2*d*, thereby visualizing the electrostatic latent images as toner images having respective colors.

The transfer rollers 5*a* to 5*d* can be adjacent to the photoconductive drums 2*a* to 2*d*, at the respective primary-transfer portions, with an intermediate transfer belt 7 being interposed therebetween. The intermediate transfer belt 7 extends between a secondary-transfer counter roller 8 and a tension roller 9 and is rotatable above the photoconductive drums 2*a* to 2*d*. The secondary-transfer counter roller 8 can be adjacent to a secondary-transfer roller 10 at a secondary-transfer portion with the intermediate transfer belt 7 being interposed therebetween. A belt cleaner 11 is provided near the tension roller 9.

Toner containers 12*a*, 12*b*, 12*c*, and 12*d*, that supply toners to the developers 4*a* to 4*d*, respectively, are located in the body 100 and are arranged in a line above the image forming units 1M, 1C, 1Y, and 1K.

A laser scanner unit (LSU) 13 is located in the body 100 below the image forming units 1M, 1C, 1Y, and 1K. A sheet cassette 14 is detachably located at the bottom of the body 100 below the LSU 13. The sheet cassette 14 houses a plurality of sheets (not shown), as recording media, stacked therein. A pickup roller 15, a feed roller 16, and a retard roller 17 are positioned near the sheet cassette 14. The pickup roller 15 removes sheets from the sheet cassette 14. The feed roller 16 and the retard roller 17, in combination, feed the sheets removed by the pickup roller 15 one at a time into a conveyance path L.

The conveyance path L extends vertically in the body 100 on one side thereof. The conveyance path L includes a pair of conveying rollers 18 designed to convey the sheet and a pair of registration rollers 19 designed to convey the sheet, at a specific time interval after a temporary stop, to the secondary-transfer portion, i.e., the nip between the secondary-transfer counter roller 8 and the secondary-transfer roller 10.

Another conveyance path L' is located beside the conveyance path L. The conveyance path L' is used when images are to be formed on both sides of the sheet and is provided with a plurality of pairs of conveying rollers 20 at appropriate intervals.

The conveyance path L extends in the body 100 to a discharge tray 21 provided on the top surface of the body 100. A fixing device 22, according to an embodiment of the present invention, and a pair of discharge rollers 23 are positioned about halfway in the conveyance path L. The body 100 has on a front face thereof an openable/closable front cover 101. If any sheets jam in the fixing device 22, or other areas, the front cover 101 is opened, and the jam can be cleared.

A process of image formation, performed by the color laser printer set forth above, will now be described.

When an image formation start signal is issued, the photoconductive drums 2*a* to 2*d* in the image forming units 1M, 1C, 1Y, and 1K rotate in a clockwise direction as indicated by the arrows in FIG. 1, at a specific processing speed. The photoconductive drums 2*a* to 2*d* are uniformly charged by the respective charging rollers 3*a* to 3*d*. The LSU 13 emits laser beams that are modulated in accordance with the image signals for the respective colors, and applies the laser beams to the respective photoconductive drums 2*a* to 2*d*. Electrostatic latent images corresponding to the respective image signals are formed on the respective photoconductive drums 2*a* to 2*d*.

First, in the magenta image forming unit 1M, a developing roller, included in the developer 4*a*, is charged with a development bias having a polarity that is the same as that of the photoconductive drum 2*a*. The charged developing roller causes the magenta toner to adhere to the electrostatic latent image formed on the photoconductive drum 2*a*, whereby the electrostatic latent image is visualized as a magenta toner image. Due to the transfer roller 5*a* being charged with a primary-transfer bias having a polarity opposite to that of the toner, the magenta toner image is primary-transferred onto the intermediate transfer belt 7, which rotates in the direction represented by the arrow shown in FIG. 1, at the primary-transfer portion (transfer nip) defined between the photoconductive drum 2*a* and the transfer roller 5*a*.

As mentioned above, the intermediate transfer belt 7, carrying the magenta toner image, moves next to cyan image forming unit 1C. In the cyan image forming unit 1C, a cyan toner image, that is formed on the photoconductive drum 2*b*, is transferred onto the intermediate transfer belt 7 at the primary-transfer portion, in the same manner as described above, so as to be superposed on the magenta toner image.

Likewise, yellow and black toner images, that are formed on the respective photoconductive drums 2*c* and 2*d* in the yellow- and black image forming units 1Y and 1K, are sequentially transferred onto the intermediate transfer belt 7, at the respective primary-transfer portions, so as to be further superposed on the magenta and cyan toner images. Thus, a full-color toner image is formed. Residual toners that were not transferred, onto the intermediate transfer belt 7, and remain on the photoconductive drums 2*a* to 2*d* are removed by the drum cleaners 6*a* to 6*d*, respectively. Thus, the photoconductive drums 2*a* to 2*d* are readied for subsequent image formation.

Meanwhile, a sheet is conveyed to the secondary-transfer portion (transfer nip) defined between the secondary-transfer counter roller 8 and the secondary-transfer roller 10. The timing of this conveyance is adjusted by the pair of registration rollers 19 so as to match the timing of the tip portion of the full-color toner image on the intermediate transfer belt 7 reaching the secondary-transfer portion. The full-color toner image is wholly secondary-transferred from the intermediate transfer belt 7 onto the sheet conveyed to the secondary-transfer portion, with the secondary-transfer roller 10 being charged with a secondary-transfer bias having a polarity opposite to that of the toner.

The sheet carrying the full-color toner image is further conveyed to the fixing device 22. The sheet is heated and pressed by the fixing device 22 so that the toner image is thermally fixed onto the sheet. The sheet carrying the now fixed toner image is discharged onto the discharge tray 21 by the pair of discharge rollers 23, and the process of image formation ends. Residual toner that was not transferred onto the sheet and remains on the intermediate transfer belt 7 is removed by the belt cleaner 11. Thus, the intermediate transfer belt 7 is readied for subsequent image formation.

Fixing Device

The fixing device 22 according to an embodiment of the present invention will now be described with reference to FIGS. 2 to 7.

Figure 2:
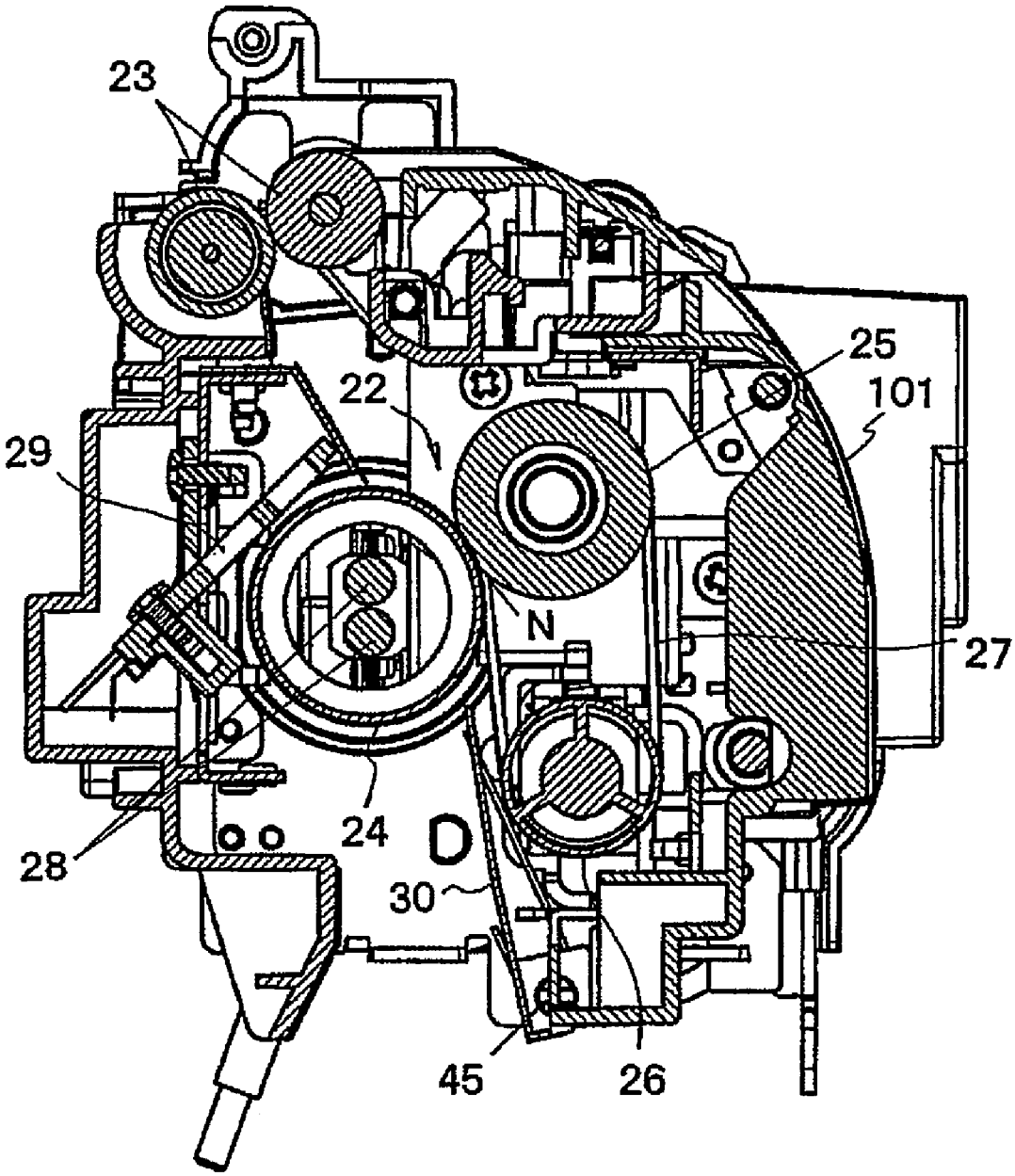
FIG. 2 is a cross-sectional view of a part (an enlarged view of X in FIG. 1), including a fixing device, of the color laser printer according to an embodiment of the present invention.
Figure 3:
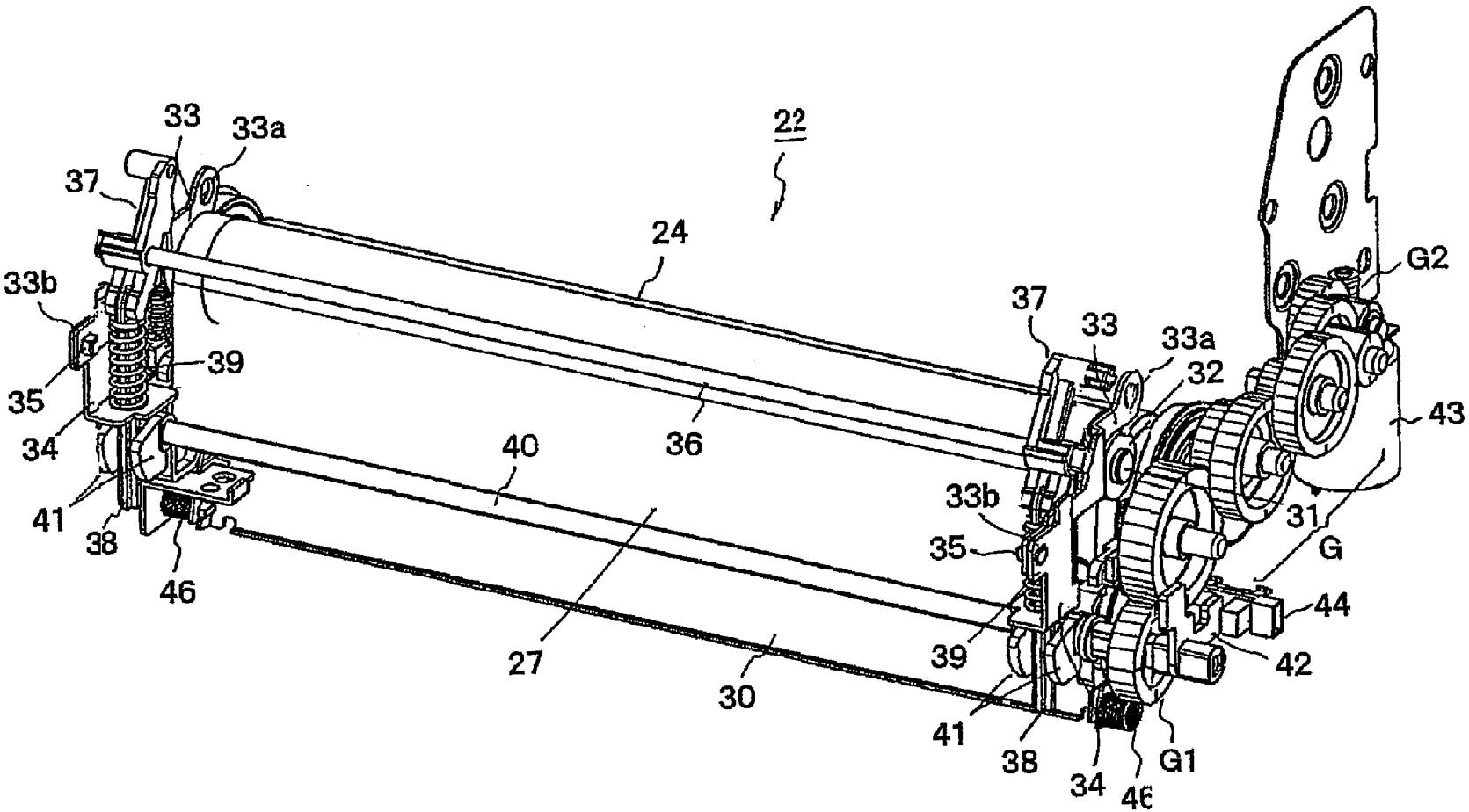
FIG. 3 is a perspective view of the fixing device according to an embodiment of the present invention.
Figure 4:
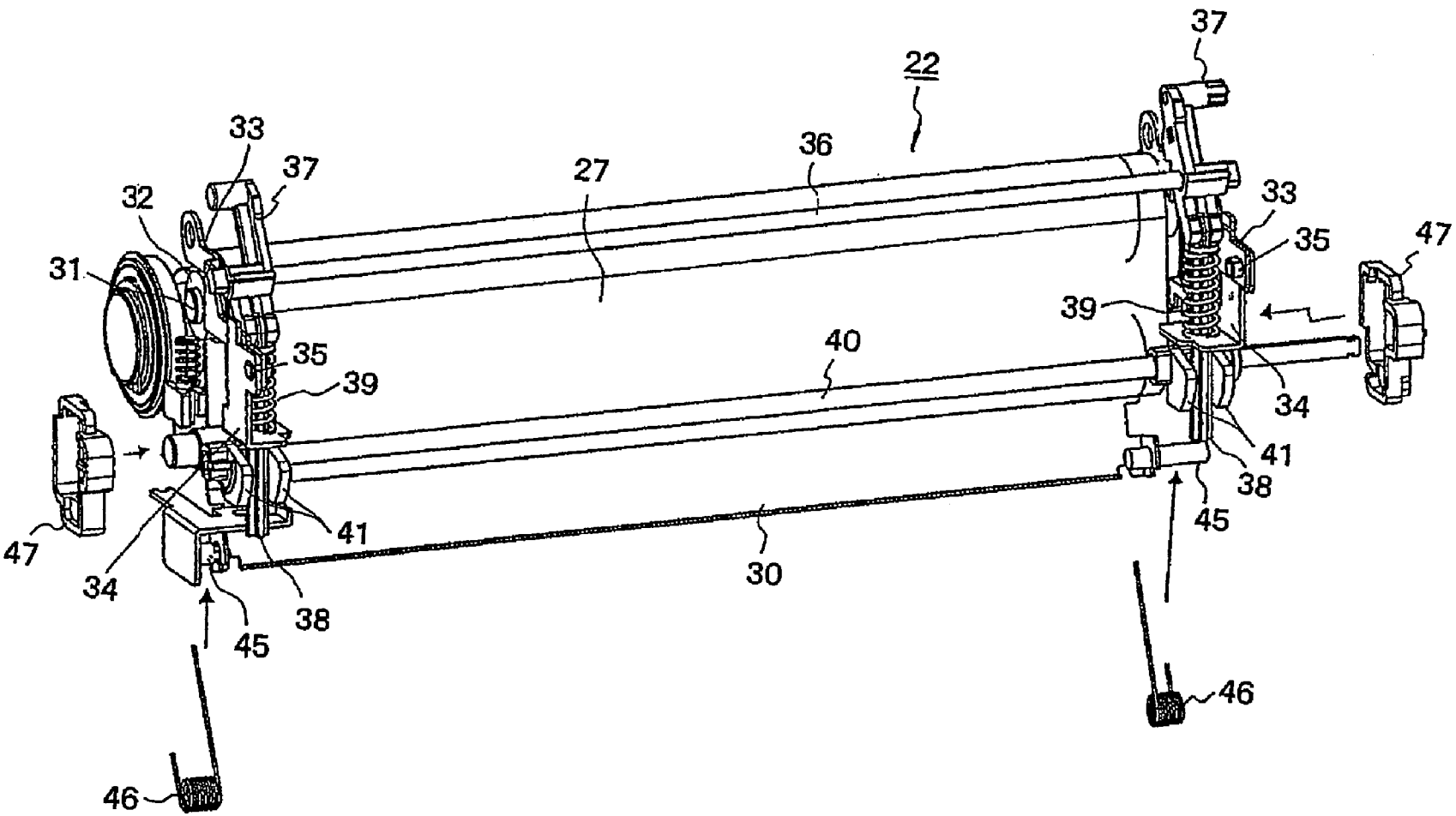
FIG. 4 is an exploded perspective view of the fixing device according to an embodiment of the present invention.
Figure 5:
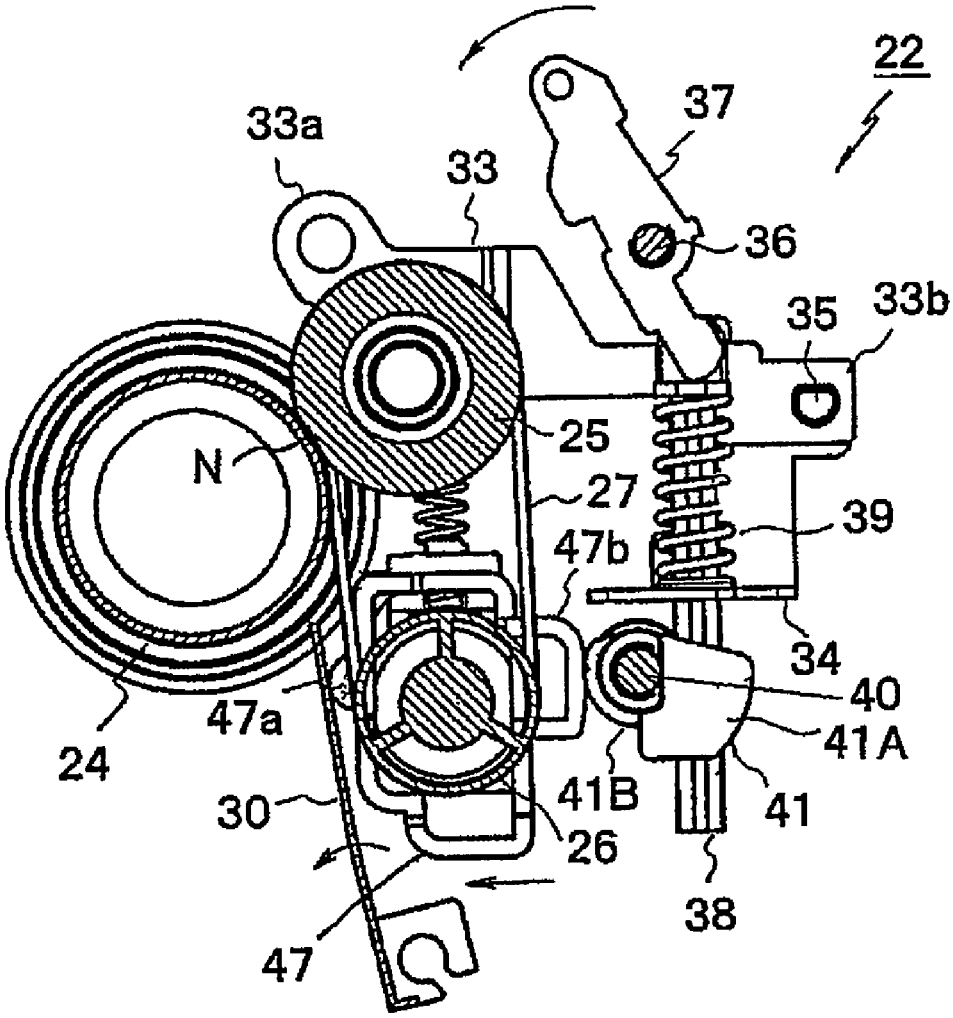
FIG. 5 is a cross-sectional view of the fixing device according to an embodiment of the present invention in a high-pressure mode.
Figure 6:
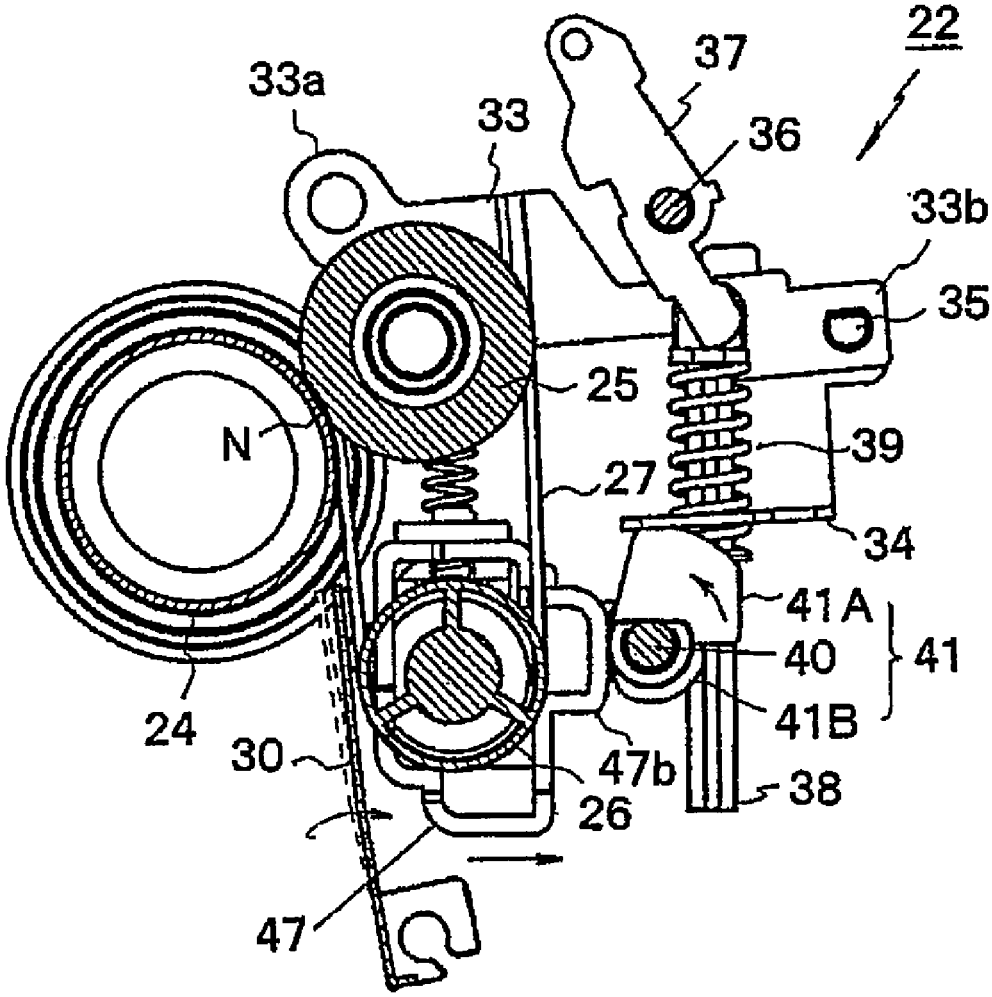
FIG. 6 is a cross-sectional view of the fixing device according to an embodiment of the present invention in a low-pressure mode.
Figure 7:
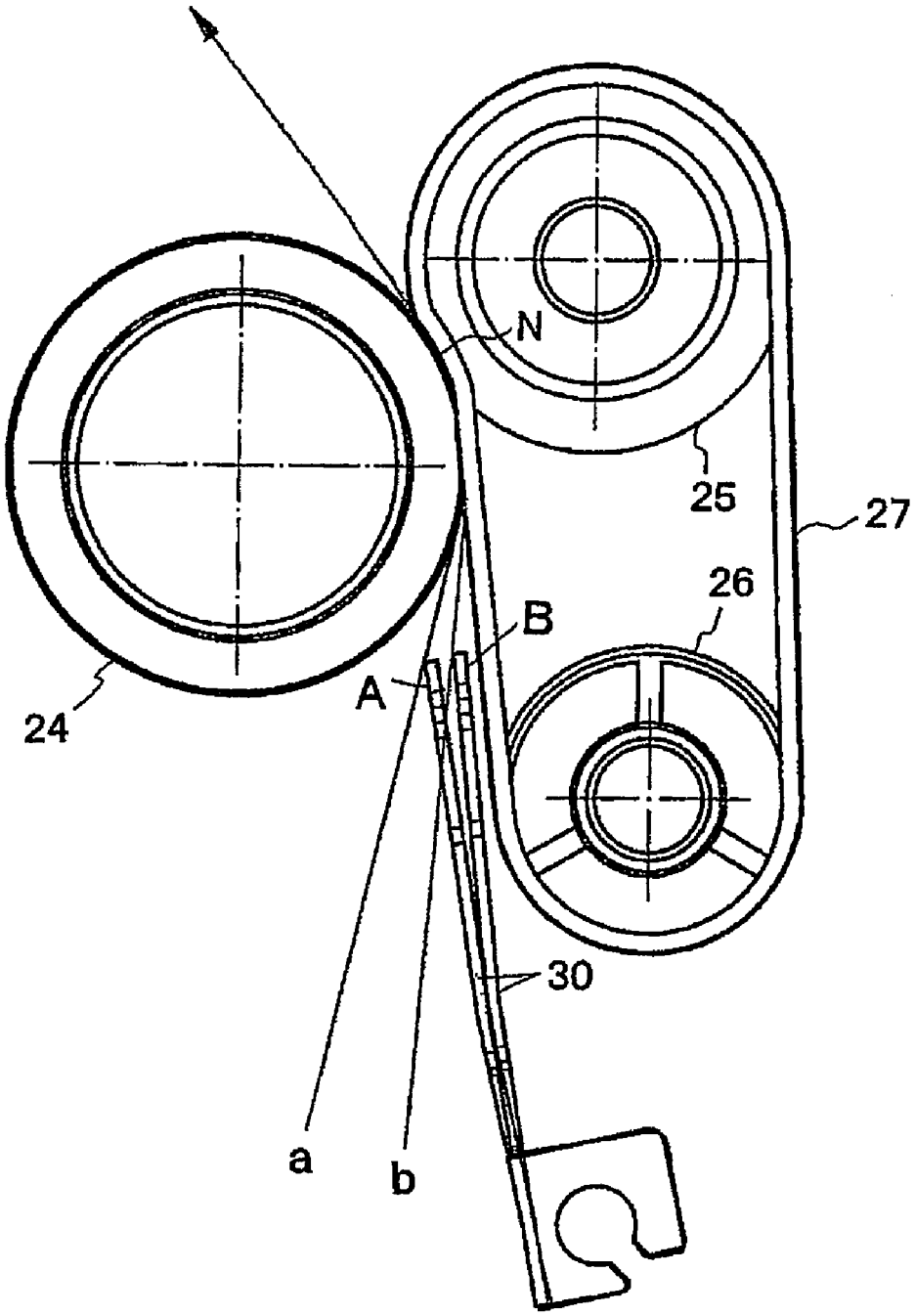
FIG. 7 illustrates the relationship between the change in the angle of an approach guide and the change in a recording medium conveyance line in the fixing device according to an embodiment of the present invention.

FIG. 2 is a cross-sectional view of a part (an enlarged view of part X in FIG. 1), including the fixing device 22, of the color laser printer. FIG. 3 is a perspective view of the fixing device 22. FIG. 4 is an exploded perspective view of the fixing device 22. FIG. 5 is a cross-sectional view of the fixing device 22 in a high-pressure mode. FIG. 6 is a cross-sectional view of the fixing device 22 in a low-pressure mode. FIG. 7 illustrates the relationship between the change in the angle of the approach guide and the change in the recording medium conveyance line.

Referring to FIG. 2, the fixing device 22 includes a heating roller 24 and a pressing roller 25 that are rotatable and are adjacent to each other. The fixing device 22 includes a tension roller 26 located below the pressing roller 25. The heating roller 24, the pressing roller 25, and the tension roller 26 are rotatable and extend substantially parallel to each other in the depth direction in FIG. 2. An endless fixing belt 27 extends between the pressing roller 25 and the tension roller 26. The pressing roller 25 is urged against the heating roller 24 by a pressing mechanism, described below, with the fixing belt 27 located therebetween. A fixing nip N having a specific pressure (fixing pressure) is created between the rollers 24 and 25.

The heating roller 24, which is a hollow member, has two heaters 28, an upper and a lower one, extending in the depth direction in FIG. 2. A thermistor 29, that detects the surface temperature of the heating roller 24, is located near the outer periphery of the heating roller 24.

An approach guide 30, that guides the sheet toward the fixing nip N, is pivotably positioned on the upstream side (the lower side in FIG. 2) in the sheet conveyance direction with respect to the fixing nip N formed between the heating roller 24 and the pressing roller 25. With the approach guide 30, the angle at which the sheet approaches the fixing nip N is adjustable.

As described above, the sheet carrying the full-color toner image is conveyed to the fixing device 22. While the sheet is conveyed through the fixing nip N between the heating roller 24 and the pressing roller 25 of the fixing device 22, the sheet is heated and pressed therebetween, whereby the full-color toner image is fixed. The sheet carrying the fixed toner image is subsequently discharged onto the discharge tray 21 by the pair of discharge rollers 23 shown in FIG. 1.

The fixing device 22 according to an embodiment includes a fixing-pressure-changing mechanism and an approach-guide-changing mechanism. The fixing-pressure-changing mechanism automatically changes the fixing device 22 between a high-pressure mode and a low-pressure mode in which the fixing pressure (the pressure produced between the pressing roller 25 and the heating roller 24) is either high and low, in accordance with the selected type of the recording medium. The approach-guide-changing mechanism changes the approach guide 30 between different angles in conjunction with the changes performed by the fixing-pressure-changing mechanism. The configurations of the fixing-pressure-changing mechanism and the approach-guide-changing mechanism will now be described with reference to FIGS. 3 and 4.

The rotational shaft 31 of the pressing roller 25 is swingably supported at two axial-direction ends thereof by a pair of right and left side plates (not shown) with bearings 32 being located therebetween. A pair of right and left pressing levers 33 are each pivotably supported at one end 33*a* thereof by corresponding side plates (not shown), with a middle portion thereof being in contact with the outer periphery of the corresponding bearing 32. When the pressing levers 33 are pivoted about the ends 33*a* thereof, so as to press the bearings 32, the pressing roller 25 is pressed against the heating roller 24 with the fixing belt 27 interposed therebetween. Thus, a fixing nip N having a specific pressure is formed between the rollers 24 and 25.

The pressing levers 33 each have the other end 33*b* thereof connected, via a pin 35, to the top end of a corresponding one of a pair of right and left pressing plates 34 that are each bent in an L shape. A pair of right and left open/close levers 37 are provided near the respective pressing plates 34 and the respective side plates. The open/close levers 37 rotate about a shaft 36 in conjunction with the open/close operation of the front cover 101 (see FIG. 1). The open/close levers 37 each have one end thereof connected to the top end of a corresponding pair of right and left rods 38. The rods 38 each extend downward through the corresponding pressing plate 34 and are each provided with a pressing spring 39, which functions as an urging member, wound therearound between the open/close lever 37 and the pressing plate 34.

A shaft 40 is rotatably positioned near the tension roller 26 and extends parallel to the axes of the tension roller 26 and the pressing roller 25. The shaft 40 is located at two axial-direction ends thereof with a pair of right and left cams 41 secured thereto. The cams 41 each extend around the corresponding rod 38 with portions thereof projecting on the right and left sides of the rod 38. Referring to FIGS. 5 and 6, each cam 41 includes a large first cam 41A and a small second cam 41B that are provided as an integral body and form a fixed angle therebetween.

When the fixing device 22 is changed to the low-pressure mode, the cams 41 each turn to a position shown in FIG. 6 and move into contact with the corresponding pressing plate 34. In this state, the cams 41 push up the respective pressing plates 34. Thus, as described below, the pressure (fixing pressure) applied from the pressing roller 25, with the aid of the pressing springs 39, is reduced. Referring to FIG. 3, the shaft 40 is provided at one end thereof with a gear G1 and a plate-like actuator 42 secured thereto.

Referring again to FIG. 3, a direct-current (DC) motor 43 is vertically located on the side having the gear G1. A pinion G2, secured to an output shaft of the DC motor 43, is connected to the gear G1 through a gear train G. Accordingly, when the DC motor 43 is driven, the rotation of the output shaft is transmitted through the pinion G2, the gear train G, and the gear G1 to the shaft 40 while the speed of rotation is reduced. Thus, the shaft 40 and the pair of right and left cams 41 and the actuator 42, that are secured to the shaft 40 simultaneously rotate.

A photo-interrupter (PI) sensor 44 is positioned near the actuator 42. The PI sensor 44 optically detects the position of the cam 41, specifically, the orientation of the cam 41 in the low-pressure mode wherein the pressure to be applied by the pressing roller 25 is reduced.

The design of the approach-guide-changing mechanism will now be described.

Referring to FIG. 4, the approach guide 30 is provided with rotational shafts 45 at lower portions of two ends thereof. The rotational shafts 45 horizontally extend and are rotatably supported by right and left side plates. That is, the approach guide 30 is supported by the right and left side plates in such a manner as to be turnable about the lower end thereof. The rotational shafts 45 are each provided with a spring 46, which is an urging member, wound therearound, causing the approach guide 30 to be urged clockwise in FIGS. 5 and 6.

Approach-guide-changing levers 47 are positioned at right and left ends on the back side (on the right side in FIGS. 5 and 6) of the approach guide 30. The approach-guide-changing levers 47 are perpendicularly slidable (horizontally in FIGS. 5 and 6) to the rotational shafts 45. The approach-guide-changing levers 47 each have a hemispherical projection 47*a* on a surface thereof facing the approach guide 30, and a rectangular block-like projection 47*b* on the opposite surface thereof. The projection 47*a* of each approach-guide-changing lever 47 is in contact with the approach guide 30, which is urged by the springs 46 so as to rotate about the rotational shaft 45 clockwise in FIGS. 5 and 6. The projection 47*b* of each approach-guide-changing lever 47 is in contact with the second cam 41B of the corresponding cam 41.

The approach-guide-changing mechanism comprises the approach-guide-changing levers 47, the second cams 41B of the cams 41 that cause the approach-guide-changing levers 47 to slide, and other relevant components.

When a sheet of plain paper is conveyed into the fixing device 22 configured as above, the high-pressure mode is automatically selected. Accordingly, the fixing pressure is set to a high value.

Specifically, when the front cover 101 is closed as shown in FIG. 1, the front cover 101 causes the open/close levers 37 to rotate about the shaft 36 in the direction of the arrow in FIG. 5.

Referring to FIG. 5, when the high-pressure mode is selected, the first cam 41A, of each cam 41, moves away from the pressing plate 34 while the second cam 41B comes into contact with the projection 47*b* of the approach-guide-changing lever 47 causing the approach-guide-changing lever 47 to slide in the direction (toward left) of the arrow in FIG. 5. Accordingly, the approach guide 30 that is in contact with the projections 47*a* of the approach-guide-changing levers 47 rotates about the rotational shaft 45 in the direction of the arrow in FIG. 5 against the force that is applied by the springs 46. Thereby, the angle of the approach guide 30 is adjusted such that the approach guide 30 is oriented as shown in FIG. 5 (to be in a position A in FIG. 7).

In the situation shown in FIG. 5, where the first cam 41A of each cam 41 is away from the pressing plate 34, the pressing plate 34 is pushed by the pressing spring 39 that is located between the open/close lever 37 and the pressing plate 34. The reactive force (spring force) created by the pressing spring 39 is transmitted through the pressing plate 34 to the pressing lever 33, causing the other end 33*b* of the pressing lever 33 to move downward.

Accordingly, the pressing lever 33 turns about the one end 33*a* thereof clockwise in FIG. 5 and pushes the bearing 32. Then, the pressing roller 25 that is rotatably supported by the bearings 32 is pressed against the heating roller 24 with the fixing belt 27 being located therebetween. This produces a fixing nip N having a specific pressure between the pressing roller 25 and the heating roller 24. When a sheet of plain paper is conveyed through the fixing nip N formed as above, a toner image is heat-pressed and fixed onto the sheet of plain paper.

In the high-pressure mode, the approach guide 30 is positioned as shown in FIG. 5 (in the position A in FIG. 7), as described above. Therefore, a sheet of plain paper is conveyed through the fixing nip N along the conveyance line a shown in FIG. 7. The curvature of the conveyance line a is greater than that of the conveyance line b, shown in FIG. 7 and described below, defined in the low-pressure mode. Hence, a greater portion of the sheet of plain paper winds around the heating roller 24. Thus, in combination with the effect caused by increasing the fixing pressure in the high-pressure mode, the fixability of the toner image onto the sheet of plain paper is advantageously increased.

In the high-pressure mode, the actuator 42 is positioned upright and therefore does not block light emitted from a light-emitting portion toward a light-receiving portion of the PI sensor 44. In this state, the PI sensor 44 detects that the fixing device 22 is in the high-pressure mode.

When an envelope is conveyed into the fixing device 22 while image formation is being performed with the front cover 101 closed, a signal indicating this situation is transmitted and the fixing device 22 is changed from the high-pressure mode to the low-pressure mode. In response to this, the DC motor 43 shown in FIG. 3 rotates the shaft 40 as described above, whereby the shaft 40 turns by 90 degrees together with the pair of right and left cams 41 and the actuator 42 secured thereto.

When the cams 41 turn as described above, the first cams 41A thereof come into contact with and push up the pressing plates 34 as shown in FIG. 6. This increases the reactive forces of the pressing springs 39, but reduces the pushing forces applied to the bearings 32 because the pressing levers 33 turn about the ends 33*a* thereof counterclockwise in FIG. 6. Accordingly, the pushing force of the pressing levers 33 against the pressing roller 25 is reduced, and the pressure applied by the pressing roller 25, i.e., the fixing pressure, is reduced.

In the low-pressure mode, the cams 41 turn by 90 degrees, and the second cams 41B therefore move away from the projections 47*b* of the approach-guide-changing levers 47. This causes the approach-guide-changing levers 47 to slide in the direction of the arrow (toward right) shown in FIG. 6 due to the forces of the springs 46 applied through the approach guide 30. The sliding of the approach-guide-changing levers 47 causes the approach guide 30 to turn about the rotational shaft 45 in the direction of the arrow (clockwise) shown in FIG. 6. Thus, as in FIG. 6, the angle, i.e., the position, of the approach guide 30 is changed from the position represented by broken lines (the position A in FIG. 7) to the position represented by solid lines (a position B in FIG. 7).

When the low-pressure mode is selected and the position of the approach guide 30 is changed from position A to position B shown in FIG. 7, the envelope to be conveyed through the fixing nip N forms the conveyance line b shown in FIG. 7. The curvature of the conveyance line b is less than that of the conveyance line a defined in the high-pressure mode. Therefore, the difference in curvature between the front and back sides of the envelope is reduced, and, in combination with the effect of reducing the fixing pressure in the low-pressure mode, the envelope is prevented from easily wrinkling. Thus, a toner image can be stably fixed onto the envelope without wrinkling the envelope.

Referring now to FIG. 3, when the fixing device 22 is changed to the low-pressure mode and the pressure (fixing pressure) applied by the pressing roller 25 is reduced through the rotation of the cams 41, the actuator 42 that turns together with the shaft 40 blocks the light emitted from the light-emitting portion toward the light-receiving portion of the PI sensor 44. In this position, the PI sensor 44 detects the presence of the first cam 41A of the corresponding cam 41. Thus, the fact that the fixing device 22 is in the low-pressure mode is recognized.

While the above embodiment relates to the situation where the present invention is used in a color laser printer with a belt-type fixing device included therein, the present invention may also be applied to monochrome image forming apparatus and the fixing devices included therein. Moreover, the fixing device may be of, for example, a roller type, instead of the belt type.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A fixing device comprising:

a heating member and a pressing member that form a fixing nip;

an approach guide positioned an upstream, in a recording-medium conveyance direction, of the fixing nip;

a fixing-pressure-changing mechanism designed to change the fixing device between a high-pressure mode and a low-pressure mode in accordance with a selected type of a recording medium; and an approach-guide-changing mechanism designed to change an angle of the approach guide in conjunction with the changing by the fixing-pressure-changing mechanism, wherein the approach-guide-changing mechanism supports and allows the approach guide to turn about one end thereof.

2. The fixing device according to claim 1, wherein, when the fixing-pressure-changing mechanism changes the fixing device to the low-pressure mode, the approach-guide-changing mechanism changes the approach guide to such an angle that a recording medium passes through the fixing nip along a conveyance line having a curvature that is less than a curvature in the high-pressure mode.

3. The fixing device according to claim 1, wherein the fixing-pressure-changing mechanism automatically changes the fixing device between the high-pressure mode and the low-pressure mode in accordance with the selected type of a recording medium.

4. The fixing device according to claim 1, wherein the low-pressure mode is used when the recording medium is an envelope.

5. The fixing device according to claim 1, wherein:

the heating member and the pressing member are rollers;

a tension roller is positioned the upstream, in a recording-medium conveyance direction, with respect to the pressing member; and an endless belt extends between the pressing member and the tension roller.

6. A fixing device comprising:

a heating member and a pressing member that form a fixing nip;

an approach guide positioned an upstream, in a recording-medium conveyance direction, of the fixing nip;

a fixing-pressure-changing mechanism designed to change the fixing device between a high-pressure mode and a low-pressure mode; and an approach-guide-changing mechanism designed to change an angle of the approach guide in conjunction with the changing by the fixing-pressure-changing mechanism, wherein the fixing-pressure-changing mechanism comprises:

a pressing lever that supports and allows the pressing member to rotate;

an urging member for urging the pressing lever in a direction such that the pressing member is pressed against the heating member; and a first cam that is rotatable so as to modify the pressing force of the urging member that is applied to the pressing member that is pressed against the heating member, and wherein the approach-guide-changing mechanism supports and allows the approach guide to turn about one end thereof, urges the approach guide with the urging member in one direction, holds and allows movement of an approach-guide-changing lever that is in contact with the approach guide, and moves the approach-guide-changing lever with a second cam integrally provided with the first cam, thereby changing the approach guide between different angles.

7. An image forming apparatus comprising a fixing device, wherein the fixing device comprises:

a heating member and a pressing member that form a fixing nip;

an approach guide positioned an upstream, in a recording-medium conveyance direction, of the fixing nip;

a fixing-pressure-changing mechanism designed to change the fixing device between a high-pressure mode and a low-pressure mode in accordance with a selected type of a recording medium; and an approach-guide-changing mechanism designed to change an angle of the approach guide in conjunction with the changing by the fixing-pressure-changing mechanism wherein the approach-guide-changing mechanism supports and allows the approach guide to turn about one end thereof.

8. The image forming apparatus according to claim 7, wherein, when the fixing-pressure-changing mechanism changes the fixing device to the low-pressure mode, the approach-guide-changing mechanism changes the approach guide to such an angle that a recording medium passes through the fixing nip along a conveyance line having a curvature that is less than a curvature in the high-pressure mode.

9. The image forming apparatus according to claim 7, wherein the fixing-pressure-changing mechanism automatically changes the fixing device between the high-pressure mode and the low-pressure mode in accordance with the selected type of a recording medium.

10. The image forming apparatus according to claim 7, wherein the low-pressure mode is used when the recording medium is an envelope.

11. An image forming apparatus comprising a fixing device, wherein the fixing device comprises:

a heating member and a pressing member that form a fixing nip;

an approach guide positioned an upstream, in a recording-medium conveyance direction, of the fixing nip;

a fixing-pressure-changing mechanism designed to change the fixing device between a high-pressure mode and a low-pressure mode; and an approach-guide-changing mechanism designed to change an angle of the approach guide in conjunction with the changing by the fixing-pressure-changing mechanism, wherein the fixing-pressure-changing mechanism comprises:

a pressing lever that supports and allows the pressing member to rotate;

an urging member for urging the pressing lever in a direction such that the pressing member is pressed against the heating member; and a first cam that is rotatable so as to modify the pressing force of the urging member that is applied to the pressing member that is pressed against the heating member, and wherein the approach-guide-changing mechanism supports and allows the approach guide to turn about one end thereof, urges the approach guide with the urging member in one direction, holds and allows movement of an approach-guide-changing lever that is in contact with the approach guide, and moves the approach-guide-changing lever with a second cam integrally provided with the first cam, thereby changing the approach guide between different angles.

* * * * *